US010966024B2

(12) United States Patent
Nakadai et al.

(10) Patent No.: US 10,966,024 B2
(45) Date of Patent: Mar. 30, 2021

(54) SOUND SOURCE LOCALIZATION DEVICE, SOUND SOURCE LOCALIZATION METHOD, AND PROGRAM

(71) Applicant: HONDA MOTOR CO., LTD., Tokyo (JP)

(72) Inventors: Kazuhiro Nakadai, Wako (JP); Hirofumi Nakajima, Tokorozawa (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 16/809,053

(22) Filed: Mar. 4, 2020

(65) Prior Publication Data

US 2020/0296508 A1 Sep. 17, 2020

(30) Foreign Application Priority Data

Mar. 15, 2019 (JP) ..... JP2019-048404

(51) Int. Cl.
*H04R 3/00* (2006.01)
*H04R 1/40* (2006.01)

(52) U.S. Cl.
CPC ..... *H04R 3/005* (2013.01); *H04R 1/406* (2013.01)

(58) Field of Classification Search
CPC ..... H04R 3/005; H04R 1/406; H04S 2400/15; H04S 2420/05
See application file for complete search history.

(56) References Cited

FOREIGN PATENT DOCUMENTS

| | | |
|---|---|---|
| JP | 2010-171785 | 8/2010 |
| JP | 2013-545382 | 12/2013 |
| WO | 2012/055940 | 5/2012 |

*Primary Examiner* — Ping Lee
(74) *Attorney, Agent, or Firm* — Rankin, Hill & Clark LLP

(57) ABSTRACT

A sound source localization device includes: a sound receiving unit that includes two or more microphones; and a sound source localization unit that transforms a sound signal received by each of the microphones into a frequency domain, models a steering vector through Fourier series expansion of an N-th (here, N is an integer equal to or larger than "1") order for the transformed sound signal of the frequency domain for each of the microphones, calculates a steering vector of an arbitrary angle using the modeled steering vector, and performs localization of a sound source using the calculated steering vector of the arbitrary angle.

7 Claims, 7 Drawing Sheets

SOUND SOURCE LOCALIZATION DEVICE, SOUND SOURCE LOCALIZATION METHOD, AND PROGRAM

REFERENCE TO RELATED APPLICATION

Priority is claimed on Japanese Patent Application No. 2019-048404, filed Mar. 15, 2019, the content of which is incorporated herein by reference.

BACKGROUND OF THE INVENTION

Field of the Invention

The present invention relates to a sound source localization device, a sound source localization method, and a program.

Description of Related Art

In speech recognition, for example, an audio signal is received by a microphone array configured by a plurality of microphones, and sound source localization and sound source separation are performed for the received audio signal. Here, the sound source localization is a process of estimating the position of a sound source. The sound source separation is a process of extracting a signal of each sound source from a plurality of sound sources. Then, in the speech recognition, feature quantities are extracted from data for which sound source localization has been performed and data of which sound sources are separated, and speech recognition is performed on the basis of the extracted feature quantities. In addition, in a case in which a microphone array is used, an audio beam is formed by calculating and correcting for a deviation of an audio arrival time for each microphone at a designated angle using a beam forming method and summing audio signals input to microphones with phase differences thereof being uniformized. Then, by spatially scanning this beam, a sound source position is estimated. In such a sound source localization process, a steering vector is calculated, and the process is performed using the calculated steering vector (for example, see Published Japanese Translation No. 2013-545382 of PCT International Application Publication (hereinafter, referred to as Patent Document 1)).

In addition, a steering vector is also used in sound source localization according to a multiple signal classification (MUSIC) method and is also used for sound source separation based on a transfer function. Here, a steering vector, for example, is a coefficient vector acquired by inverting the phase of a transfer function in the beam forming method.

SUMMARY OF THE INVENTION

In a case in which sound source localization is performed using the beam forming method or the MUSIC method, it is necessary to prepare a steering vector for each discrete angle (a steering vector database) in advance. However, in a conventional technology, the amount of calculation of a steering vector for each discrete angle is large, and a certain time is required for the calculation.

An aspect of the present invention is realized in view of the problems described above, and an object thereof is to provide a sound source localization device, a sound source localization method, and a program capable of reducing the amount of calculation of steering vectors.

In order to solve the problems described above, the present invention employs the following aspects.

(1) According to one aspect of the present invention, there is provided a sound source localization device including: a sound receiving unit that includes two or more microphones; and a sound source localization unit that transforms a sound signal received by each of the microphones into a frequency domain, models a steering vector through Fourier series expansion of an N-th (here, N is an integer equal to or larger than "1") order for the transformed sound signal of the frequency domain for each of the microphones, calculates a steering vector of an arbitrary angle using the modeled steering vectors, and performs localization of a sound source using the calculated steering vector of the arbitrary angle.

(2) In the aspect (1) described above, a storage unit that stores a Fourier base function is further included, M is the number of the microphones, m (an integer between "1" to M) represents an order of the microphone, $\theta_k$ (here, k is an integer from "1" to K) represents a discrete direction, $\exp(in\theta_k)$ is a Fourier base function of an n-th order for an angle θ, and $C_{nm}$ is a Fourier coefficient, and the sound source localization unit may perform sound source localization using a beam forming method and calculate a steering coefficient $G_m(\theta_k)$ of the steering vector using the following Equation.

$$G_m(\theta_k) = \sum_{n=-N}^{N} C_{nm}\exp(in\theta_k)$$

(3) In the aspect (2) described above, the sound source localization unit may calculate a beam forming output Y by multiplying a matrix of the Fourier base function having K rows and (2N+1) columns by a matrix of the Fourier coefficients having (2N+1) rows and M columns.

(4) In the aspect (2) or (3) described above, the sound source localization unit may select N for which (M+K)(2N+1) is smaller than (M×K).

(5) In any one of the aspects (2) to (4) described above, x is exp(inθ), f(x) is $d|Y(\theta)|^2/d\theta$, Y(θ) is a beam forming output, and β is a coefficient, and the sound source localization unit may perform sound source localization by acquiring an angle θ at which the beam forming output Y(θ) becomes a maximum by solving the following Equation.

$$x^{2N} f(x) = \sum_{n=0}^{4N+1} \beta_{n-2N} x^n = 0$$

(6) According to one aspect of the present invention, there is provided a sound source localization method that is a sound source localization method in a sound source localization device including a sound receiving unit that includes two or more microphones, the sound source localization method including: transforming a sound signal received by each of the microphones into a frequency domain, modeling a steering vector through Fourier series expansion of an N-th (here, N is an integer equal to or larger than "1") order for the transformed sound signal of the frequency domain for each of the microphones, calculating a steering vector of an arbitrary angle using the modeled steering vectors, and performing localization of a sound source using the calculated steering vector of the arbitrary angle by using a sound source localization unit.

(7) According to one aspect of the present invention, there is provided a computer-readable non-transitory storage medium storing a program causing a computer of a sound source localization device including a sound receiving unit that includes two or more microphones to execute: transforming a sound signal received by each of the microphones into a frequency domain, modeling a steering vector through Fourier series expansion of an N-th (here, N is an integer equal to or larger than "1") order for the transformed sound signal of the frequency domain for each of the microphones, calculating a steering vector of an arbitrary angle using the modeled steering vector, and performing localization of a sound source using the calculated steering vector of the arbitrary angle.

According to the aspect (1), (6), or (7) described above, a steering vector is modeled through Fourier series expansion of an N-th (here, N is an integer equal to or larger than "1") order for each microphone, and accordingly, the amount of calculation of steering vectors can be decreased. In addition, according to the aspect (1), (6), or (7) described above, a steering vector of an arbitrary angle can be calculated.

According to the aspects (2) and (3) described above, by calculating a steering vector coefficient using the equation described above, the amount of calculation of steering vectors can be decreased.

According to the aspect (4) described above, since N for which (M+K)(2N+1) is smaller than (M×K) is selected, accordingly, the amount of calculation of steering vectors can be smaller than that of a conventional case.

According to the aspect (5) described above, θ for which an output becomes a maximum can be directly acquired as a solution of a polynomial without causing the angle θ to be discrete. In addition, according to the aspect (5) described above, when N is small, calculation can be performed relatively quickly, and an error becomes small.

DETAILED DESCRIPTION OF THE INVENTION

Hereinafter, embodiments of the present invention will be described with reference to the drawings.

[Sound Processing Device 1]

Figure 1:
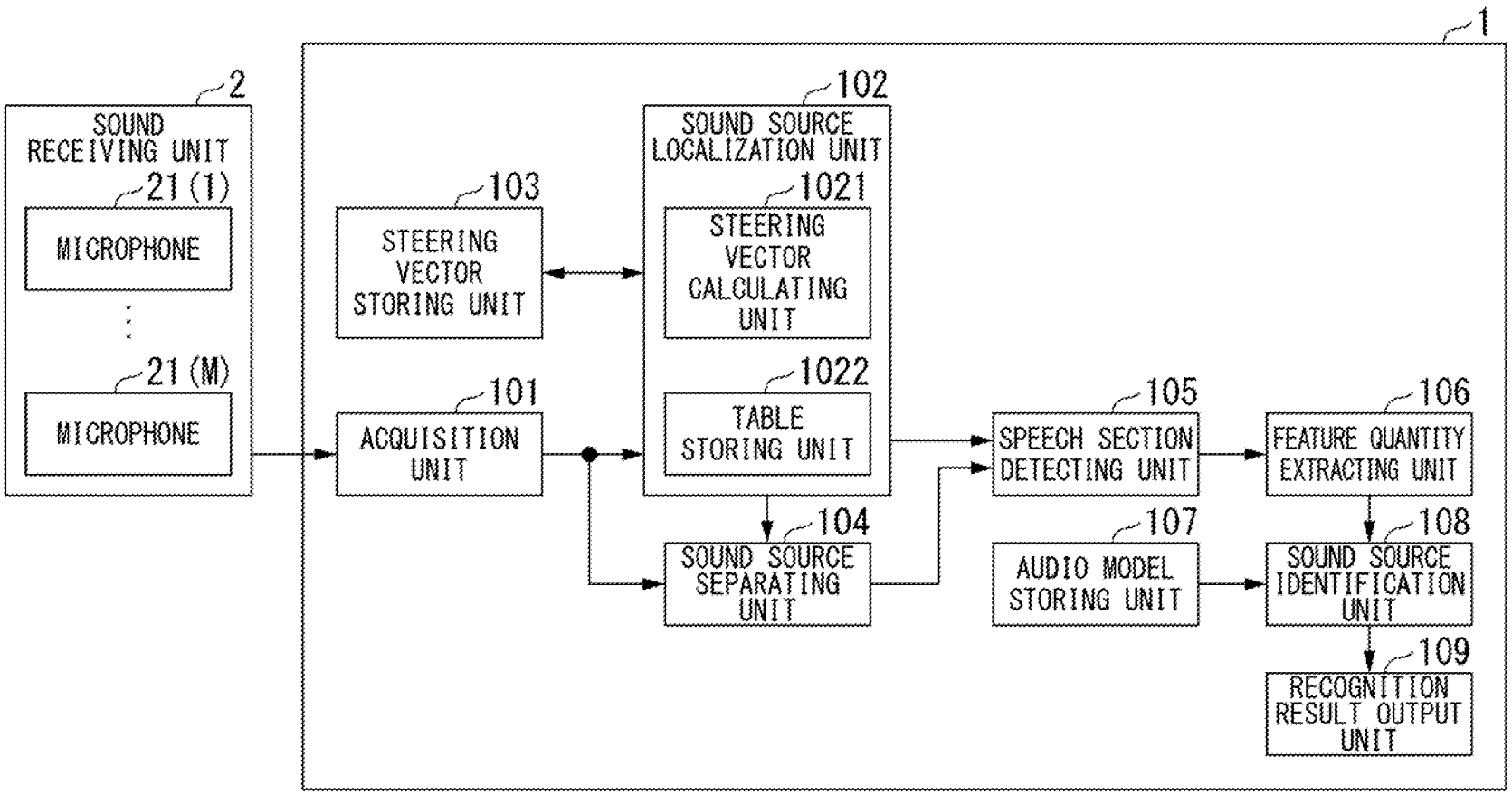
FIG. 1 is a block diagram illustrating a configuration example of a sound processing device according to this embodiment.

FIG. 1 is a block diagram illustrating a configuration example of a sound processing device 1 according to this embodiment. As illustrated in FIG. 1, the sound processing device 1 includes an acquisition unit 101, a sound source localization unit 102, a steering vector storing unit 103, a sound source separating unit 104, a speech section detecting unit 105, a feature quantity extracting unit 106, an audio model storing unit 107, a sound source identification unit 108, and a recognition result output unit 109. The sound source localization unit 102 includes a steering vector calculating unit 1021 and a table storing unit 1022.

In addition, a sound receiving unit 2 is connected to the sound processing device 1 in a wired or wireless manner.

The sound receiving unit 2 is a microphone array configured by M (here, M is an integer equal to or greater than "2") microphones 21 (21(1), . . . , 21(M)). The sound receiving unit 2 receives an audio signal generated by a sound source and outputs the audio signal of M channels that has been received to the acquisition unit 101. In the following description, in a case in which one microphone among the M microphones is not identified, it will be simply referred to as a microphone 21.

The acquisition unit 101 acquires an analog audio signal of M channels output by the sound receiving unit 2 and transforms the acquired analog audio signal into a frequency domain through a short-time Fourier transform. In addition, a plurality of audio signals output by a plurality of microphones of the sound receiving unit 2 are sampled using signals of the same sampling frequency. The acquisition unit 101 outputs an audio signal of M channels converted into digital to the sound source localization unit 102 and the sound source separating unit 104.

The sound source localization unit 102 sets a direction of each sound source for every frame having a length set in advance (for example, 20 ms) on the basis of an audio signal of M channels output by the sound receiving unit 2 (sound source localization). The steering vector calculating unit 1021 of the sound source localization unit 102 calculates a steering vector of an arbitrary angle, for example, using a beam forming (BF) method using a table stored in the table storing unit 1022. Here, a steering vector represents power for each direction. In addition, a method of calculating a steering vector will be described later. The steering vector calculating unit 1021 stores the calculated steering vector in the steering vector storing unit 103. The sound source localization unit 102 sets a sound source direction of each sound source on the basis of the calculated steering vector. The sound source localization unit 102 outputs sound source direction information representing sound source directions to the sound source separating unit 104 and the speech section detecting unit 105. Information stored in the table storing unit 1022 will be described later.

The steering vector storing unit 103 stores a steering vector. The steering vector storing unit 103 stores a steering vector for each microphone 21 and for each angle of a sound source, for example, when the sound source is moved at intervals of 15 degrees. As will be described later, the stored steering vector is modeled using complex Fourier coefficients of the N-th order.

The sound source separating unit 104 acquires sound source direction information output by the sound source localization unit 102 and an audio signal of M channels output by the sound receiving unit 2. The sound source separating unit 104 separates an audio signal of the M channels into audio signals of individual sound sources that are audio signals representing components of sound sources on the basis of the sound source directions represented by the sound source direction information. For example, when separating an audio signal into audio signals of individual sound sources, the sound source separating unit 104 uses a geometric-constrained high-order decorrelation-based source separation (GHDSS) method. The sound source separating unit 104 acquires spectrums of the separated audio signals and outputs the acquired spectrums to the speech section detecting unit 105.

The speech section detecting unit 105 acquires sound source direction information output by the sound source localization unit 102 and spectrums of audio signals output by the sound source separating unit 104. The speech section detecting unit 105 detects a speech section of each sound source on the basis of the spectrums of the separated audio signals and the sound source direction information that have been acquired. For example, the speech section detecting unit 105 performs threshold processing for a steering spectrum, thereby simultaneously performing sound source detection and speech section detection. The speech section detecting unit 105 outputs detection results acquired through detection, direction information, and spectrums of audio signals to the feature quantity extracting unit 106.

The feature quantity extracting unit 106 calculates an audio feature quantity for speech recognition for each sound source from the separated spectrums output by the speech section detecting unit 105. For example, the feature quantity extracting unit 106 calculates an audio feature quantity by calculating a static Mel-scale log spectrum (MSLS), a delta MSLS, and one delta power level for every predetermined time (for example, 10 ms). In addition, the MSLS is obtained by performing an inverse discrete cosine transformation of a Mel-Frequency Cepstrum Coefficient (MFCC) using the spectrum feature quantity as a feature quantity of audio recognition. The feature quantity extracting unit 106 outputs the obtained audio feature quantity to the sound source identification unit 108.

The audio model storing unit 107 stores a sound source model. The sound source model is a model that is used for allowing the sound source identification unit 108 to identify the received audio signal. The audio model storing unit 107 stores an audio feature quantity of an audio signal to be identified as a sound source model in association with information representing a sound source name for each sound source.

The sound source identification unit 108 identifies a sound source by referring to an audio model stored by the audio model storing unit 107 on the basis of an audio feature quantity output by the feature quantity extracting unit 106. The sound source identification unit 108 outputs an identification result acquired through identification to the recognition result output unit 109.

For example, the recognition result output unit 109 is an image display unit and displays an identification result output by the sound source identification unit 108.

[Process According to General Beam Forming Method]

Figure 2:
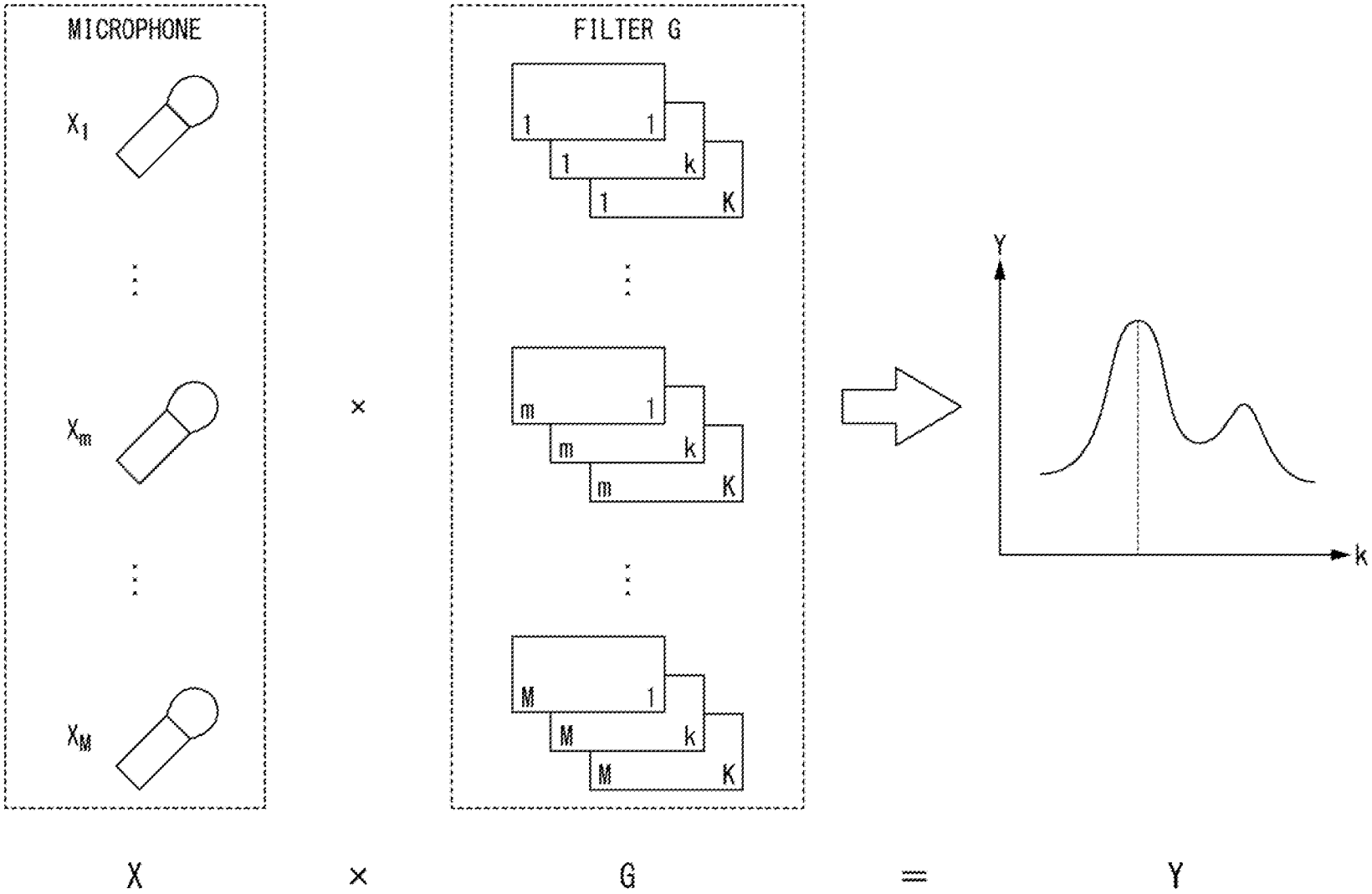
FIG. 2 is a diagram illustrating the number of times of calculation in beam forming according to a conventional technology.

Next, an overview of a processing example according to a beam forming method will be described. FIG. 2 is a diagram illustrating the number of times of calculation in beam forming according to a conventional technology. In FIG. 2, some of subscripts are omitted.

An observation signal $X_m$ converted into the frequency domain by the acquisition unit 101 is represented using the following Equation (1).

$$X_m(\omega, i)=F[x_m(t,i)] \tag{1}$$

In Equation (1), F[·] represents a short-time Fourier transform. $x_m(t, i)$ represents a signal observed by an m-th microphone 21, t is a time, and i is an index representing a section of the Fourier transform. In addition, $X_m(\omega, i)$ is a short-time Fourier coefficient of $x_m(t, i)$, and ω is a frequency. In a case in which observation is performed using M microphones, an observation vector is defined as in the following Equation (2) by aligning short-time Fourier coefficients of observed data.

$$x(\omega, i)=[X_1(\omega,i), \ldots, X_M(\omega,i)]^T \tag{2}$$

In Equation (2), T represents transposition of a matrix/vector.

In a beam forming method of the case of sound source localization in one dimension in a horizontal direction, an output value $Y_k$ of beam forming is calculated using the following Equation (3) for $\theta_k$(k=1, 2, 3, . . . , K) as a discrete angle. In description presented below, an index i will be omitted.

$$Y_k = \sum_{m=1}^{M} X_m(\omega)G_m(\theta_k, \omega) \tag{3}$$

In Equation (3), $G_m(\theta_k, \omega)$ is a steering coefficient (a beam forming coefficient) of the m-th microphone 21(m). Here, the steering coefficient is a coefficient of the steering vector. In addition, the steering vector is a column vector in which phase responses for discrete frequencies in a direction forming an angle $\theta_k$ with respect to a microphone are aligned for each microphone.

An output value $Y_k$ of beam forming is represented as in the following Equation (6) using an input vector x of the following Equation (4) and a steering vector $g_k$ of the following Equation (5). In Equations (4) and (5), T represents a transposition symbol.

$$x=[X_1(\omega)X_2(\omega), \ldots, X_M(\omega)]^T \tag{4}$$

$$g_k=[G_1(\theta_k, \omega)G_2(\theta_k, \omega), \ldots, G_M(\theta_k, \omega)] \tag{5}$$

$$Y_k=g_k x \tag{6}$$

Equation (6) can be represented in the following Equation (7) using a matrix and a vector. In the following description, the process is independently performed for each frequency ω, and thus description of (ω) will be omitted.

$$\begin{bmatrix} Y_1 \\ Y_2 \\ \vdots \\ Y_K \end{bmatrix} = \begin{bmatrix} G_1(\theta_1) & \ldots & G_M(\theta_1) \\ \vdots & \ddots & \vdots \\ G_1(\theta_K) & \ldots & G_M(\theta_K) \end{bmatrix} \begin{bmatrix} X_l \\ X_2 \\ \vdots \\ X_K \end{bmatrix} \tag{7}$$

Here, when an incidence angle on the plane is set to θ, an average power level of the beam former output $Y_k$ is acquired. In the beam forming method, phases of sound waves arriving in a sound source direction are uniformized and added, and accordingly, the sound waves arriving in the sound source direction are emphasized. In accordance with this, an audio beam is formed. In the beam forming method, by spatially scanning this beam, when the direction coincides with a real sound source direction, a peak appears in a spatial spectrum. In the beam forming method, the position of a sound source (an arrival direction) is estimated using this peak position.

However, M times of multiplication of complex numbers are required for calculating a direction of a certain frequency using Equation (7). Accordingly, when calculated for all the angles, MK times are required as the number of times of multiplication. For example, in order to perform sound source localization with accuracy of an azimuth angle of 5°, k=72. In a case in which the number M of microphones is 32, 2304 (=72×32) times of multiplication are required.

[Calculation in Sound Source Localization According to This Embodiment]

Next, a calculation method in sound source localization according to this embodiment will be described. Also in the following description, description of (ω) will be omitted.

In this embodiment, the steering vector calculating unit 1021 models a steering coefficient (a beam forming coefficient) $G_m(\theta_k)$ for each microphone 21 using a complex Fourier coefficient of the N-th order as in the following Equation (8).

$$G_m(\theta_k) = \sum_{n=-N}^{N} C_{nm}\exp(in\theta_k) \tag{8}$$

In Equation (8), $C_{nm}$ is a Fourier coefficient of beam forming (hereinafter, simply referred to as a Fourier coefficient), and i represents an imaginary unit. Here, $C_{nm}$ and $C_{-nm}$ have a conjugate relationship.

[Method for Acquiring Coefficient]

Here, as an example, a method for determining a coefficient Cn(ω) in a case in which a complex amplitude model given in Equation (8) is introduced for a one-dimensional steering coefficient $G(\theta_k)$ having only an incidence angle θ as its variable will be described. In the following description, for simplification, ω will be omitted and will be described as $C_n$.

When the number of transfer functions that are actually measured is L, and incidence angles at that time are $\theta_1$ (here, 1=1, 2, 3, . . . , L), simultaneous equations of the following Equation (9) are acquired.

$$\begin{aligned} G(\theta_1) &= \sum_{n=N}^{N} C_n\exp(in\theta_1) \\ G(\theta_2) &= \sum_{n=N}^{N} C_n\exp(in\theta_2) \\ &\vdots \\ G(\theta_L) &= \sum_{n=N}^{N} C_n\exp(in\theta_L) \end{aligned} \tag{9}$$

These simultaneous equations can be described using a matrix and a vector as in the following Equation (10).

$$g=Ac \tag{10}$$

In Equation (10), g is an actually-measured steering vector, c is a coefficient vector, and A is a steering coefficient vector of a model. The vectors are represented in the following Equations (11) to (13).

$$g=[G(\theta_1)G(\theta_2) \ldots G(\theta_L)]^T \tag{11}$$

$$c=[C_{-N}C_{-N+1} \ldots C_{-1}C_{-0}C_1 \ldots C_N]^T \tag{12}$$

$$A=[a1^T a2^T \ldots al \ldots aL^T]^T \tag{13}$$

In Equation (13), a1 is represented in the following Equation (14).

$$\begin{aligned} al=[&\exp((-iN\theta_l) \ldots \exp(-i(N-1)\theta_l) \ldots \exp(-i\theta_l)l \\ &\exp(i\theta_l) \ldots \exp(iN\theta_l)]^T \end{aligned} \tag{14}$$

The coefficient vector c to be acquired from Equation (10) can be acquired as the following Equation (15).

$$c=A^+g \tag{15}$$

In Equation (15), $A^+$ is a pseudo inverse matrix (a Moore-Penrose pseudo inverse matrix) of A. In accordance with Equation (15), generally, in a case in which the number L of simultaneous equations is larger than the number (2N+1) of variables (in a case in which L>2N+1), the coefficient vector is obtained as a solution for which a sum of squares error becomes a minimum. On the other hand, otherwise (in the case of L≤2N+1), the coefficient vector is obtained as a solution for which a norm of the solution becomes a minimum among solutions of Equation (9).

Next, an output value $Y_k$ of beam forming can be calculated as in the following Equation (16).

$$\begin{aligned} Y_k &= \sum_{m=1}^{M} X_m\left\{\sum_{n=-N}^{N} C_{nm}\exp(in\theta_k)\right\} \\ &= \sum_{m=1}^{M}\sum_{n=-N}^{N}\{X_m C_{nm}\exp(in\theta_k)\} \\ &= \sum_{n=-N}^{N}\sum_{n=-N}^{N}\{X_m C_{nm}\exp(in\theta_k)\} \\ &= \sum_{n=-N}^{N}\exp(in\theta_k)\sum_{n=-N}^{N}\{X_m C_{nm}\} \end{aligned} \tag{16}$$

In Equations (8) and (16), although description of (ω) is omitted, $X_m(\omega)$ and $C_m(\omega)$ are represented.

Equations (8) and (16) are represented using a matrix/vector as in the following Equation (17).

$$\begin{bmatrix} G_1(\theta_1) & \ldots & G_M(\theta_1) \\ \vdots & \ddots & \vdots \\ G_1(\theta_K) & \ldots & G_M(\theta_K) \end{bmatrix} = \begin{bmatrix} \exp(-iN\theta_1) & \ldots & \exp(-iN\theta_1) \\ \vdots & \ddots & \vdots \\ \exp(-iN\theta_K) & \ldots & \exp(-iN\theta_K) \end{bmatrix} \begin{bmatrix} C_{1,-N} & \ldots & C_{M,-N} \\ \vdots & \ddots & \vdots \\ C_{1,N} & \ldots & C_{M,N} \end{bmatrix} \tag{17}$$

In Equation (17), a left side is a beam forming coefficient. In the beam forming coefficient, the number of rows is the number K of directions, and the number of columns is the number M of microphones. A first item of the right side is a Fourier base function and has a number of rows which is the number K of directions (the number of discrete angles)

and has a number of columns which is 2N+1 (the number of Fourier series). In addition, a second item of the right side is a Fourier coefficient of beam forming and has a number of rows which is 2N+1 (the number of Fourier series) and has a number of columns which is the number M of microphones.

Here, G=SC is set in Equation (17).

In a case in which calculation is performed using a Fourier model, the beam forming output $Y_k$ can be represented as $Y_k=Gx=SCx=S(Cx)$.

Here, as represented in Equation (17), S is a matrix having K rows and (2N+1) columns, and K(2N+1) number of times of multiplication are required. In addition, as in Equation (17), C is a matrix having 2N+1 rows and M columns, and (2N+1)M times of multiplication are required. For this reason, a sum of the numbers of times of multiplication represented in Equation (17) is (M+K)(2N+1).

The calculation of $\exp(in\theta_k)$ is a process of only referring to a table prepared in advance and thus is excluded from the number of times of calculation. This table of $\exp(in\theta_k)$ is stored in the table storing unit 1022 in advance.

The model order of an ordinary Fourier coefficient has a value smaller than the number M of microphones and the number K of discrete angles, and accordingly, the amount of calculation can be decreased.

For example, in a case in which the number of microphones M=32, the number of discrete angles K=72, and the complex Fourier model order N=5, the number of times of calculation is 1144 (=(2N+1)(M+K)=11*104). As described above, since the ordinary number of times of calculation is 2,304, calculation can be performed with about half of the ordinary number of times of calculation.

[Comparison of Number of Times of Calculation]

Next, an example of comparison between the numbers of times of calculation according to a conventional technology and this embodiment will be described.

Figure 3:
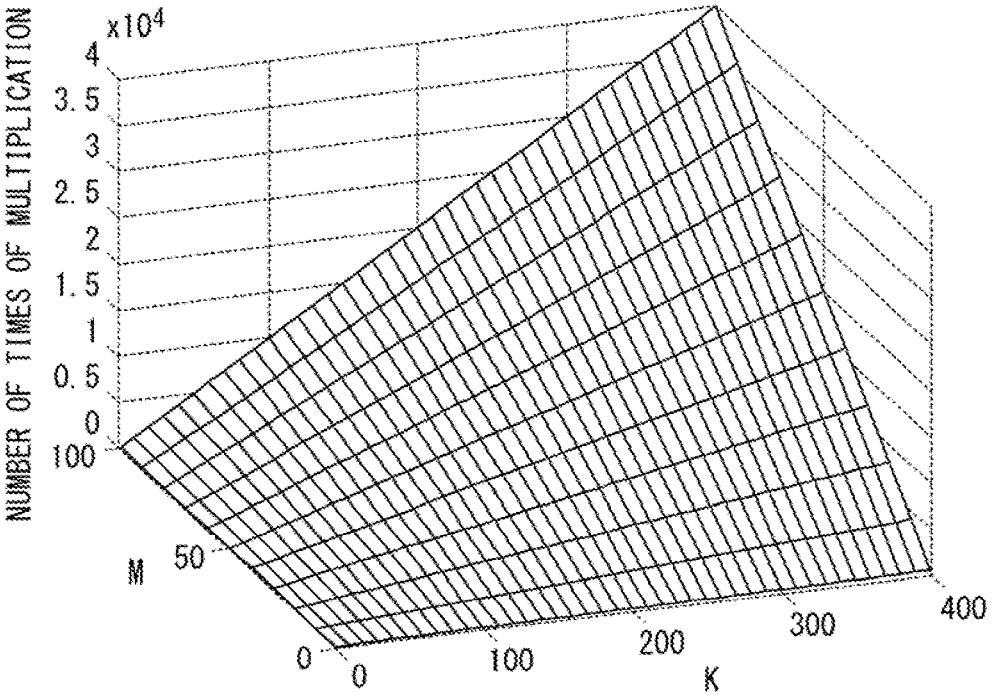
FIG. 3 is a diagram illustrating an example of the number of times of calculation according to a conventional technology.

FIG. 3 is a diagram illustrating an example of the number of times of calculation according to a conventional technology. A horizontal first axis represents the number M of microphones, a horizontal second axis represents the number K of discrete angles, and a vertical axis represents the number of times of multiplication. As illustrated in FIG. 3, in a case in which the number of microphones M=100, and the number K of discrete angles is 400, the number of times of multiplication is about $4\times10^4$.

Figure 4:
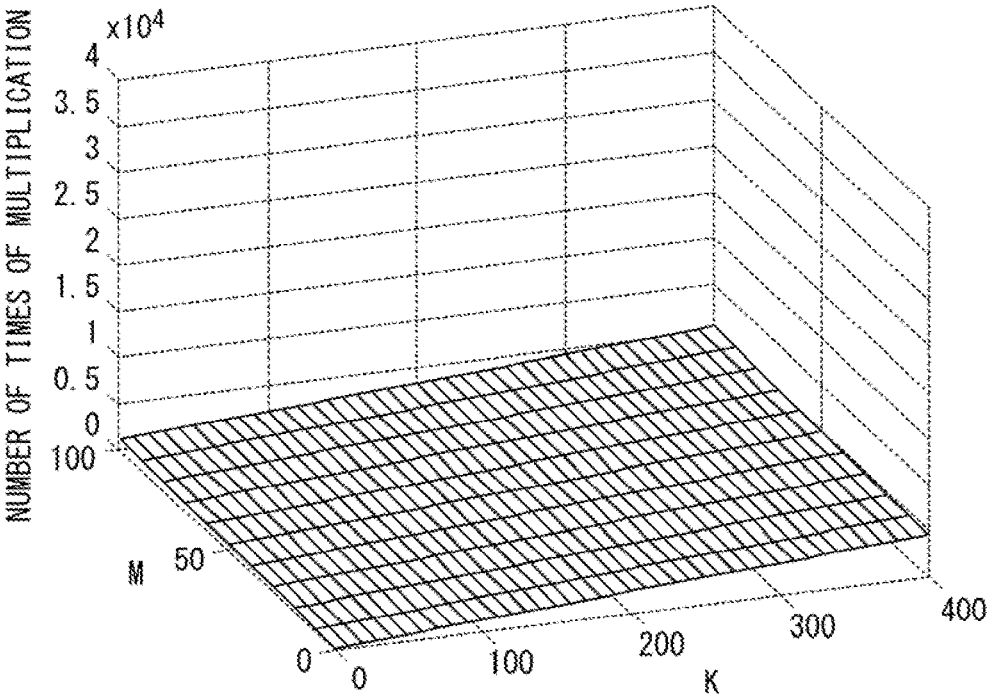
FIG. 4 is a diagram illustrating an example of the number of times of calculation according to this embodiment in a case in which a complex Fourier model order N is the 5th.
Figure 5:
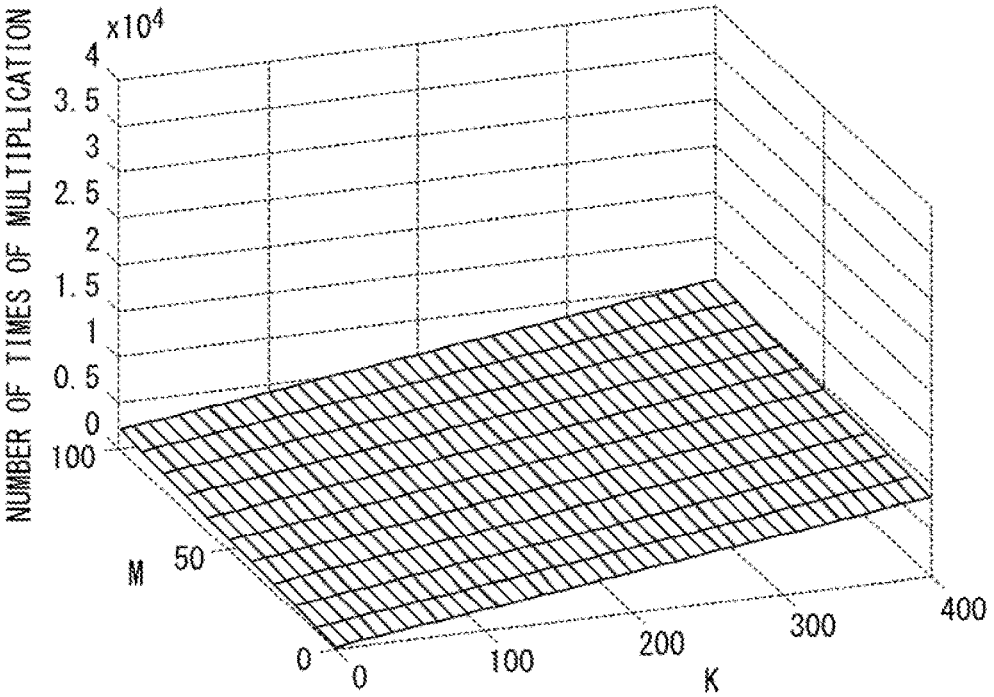
FIG. 5 is a diagram illustrating an example of the number of times of calculation according to this embodiment in a case in which a complex Fourier model order N is the 10th.
Figure 6:
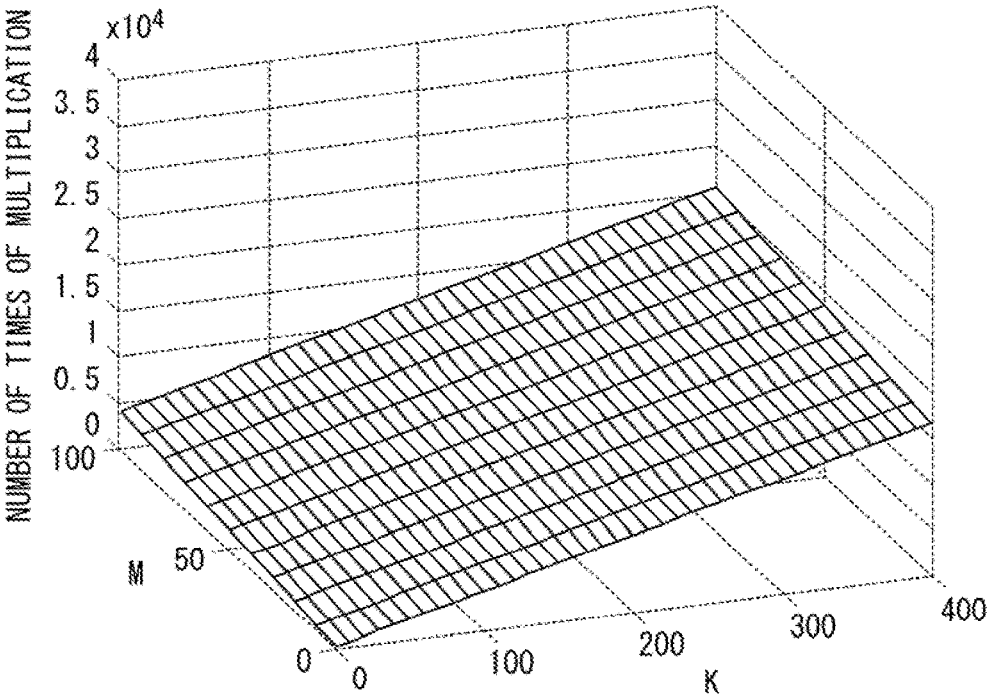
FIG. 6 is a diagram illustrating an example of the number of times of calculation according to this embodiment in a case in which a complex Fourier model order N is the 20th.
Figure 7:
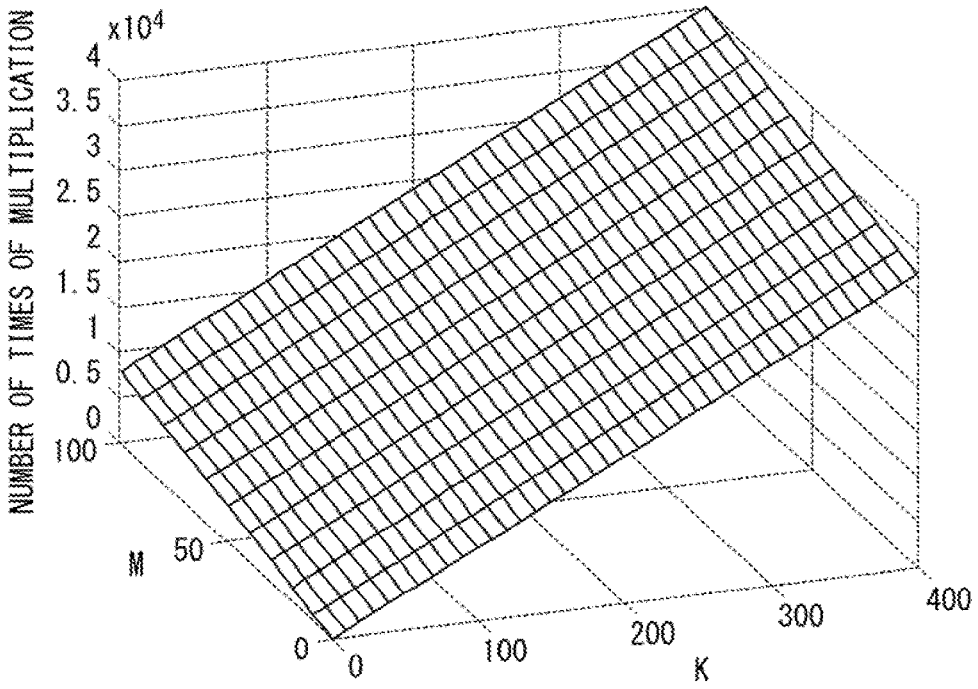
FIG. 7 is a diagram illustrating an example of the number of times of calculation according to this embodiment in a case in which a complex Fourier model order N is the 40th.

FIGS. 4 to 7 are diagrams illustrating examples of the number of times of calculation according to this embodiment. FIG. 4 is a diagram illustrating an example of the number of times of calculation according to this embodiment in a case in which a complex Fourier model order N is the 5th. FIG. 5 is a diagram illustrating an example of the number of times of calculation according to this embodiment in a case in which a complex Fourier model order N is the 10th. FIG. 6 is a diagram illustrating an example of the number of times of calculation according to this embodiment in a case in which a complex Fourier model order N is the 20th. FIG. 7 is a diagram illustrating an example of the number of times of calculation according to this embodiment in a case in which a complex Fourier model order N is the 40th. Axes represented in FIGS. 4 to 7 are the same as those illustrated in FIG. 3.

As illustrated in FIG. 4, in a case in which the number of microphones M=100, the number of discrete angles K is 400, and the complex Fourier model order N is the 5th, the number of times of multiplication is about $0.5\times10^4$. The number of times of multiplication is decreased to ⅛ times of M×K according to the conventional technology.

As illustrated in FIG. 5, in a case in which the number of microphones M=100, the number of discrete angles K is 400, and the complex Fourier model order N is the 10th, the number of times of multiplication is about $1\times10^4$. The number of times of multiplication is decreased to ¼ times of M×K according to the conventional technology.

As illustrated in FIG. 6, in a case in which the number of microphones M=100, the number of discrete angles K is 400, and the complex Fourier model order N is the 20th, the number of times of multiplication is about $2\times10^4$. The number of times of multiplication is decreased to ½ times of M×K according to the conventional technology.

As illustrated in FIG. 7, in a case in which the number of microphones M=100, the number of discrete angles K is 400, and the complex Fourier model order N is the 40th, the number of times of multiplication is about $4\times10^4$. The number of times of multiplication in this case is equal to M×K according to the conventional technology. In addition, the complex Fourier model order N=40 corresponds to modeling with the same fineness as that of a case in which there are 81 points of discrete angles M.

As illustrated in FIGS. 3 to 7, in a case in which the complex Fourier model order N is low, when M and K are large, the effect of decreasing the amount of calculation becomes high. On the other hand, in a case in which the complex Fourier model order N is high, the effect of decreasing the amount of calculation becomes low.

[Relationship Between the Number of Microphones and the Number of Times of Multiplication]

Next, a relationship between the number of microphones and the number of times of multiplication according to this embodiment will be described.

Figure 8:
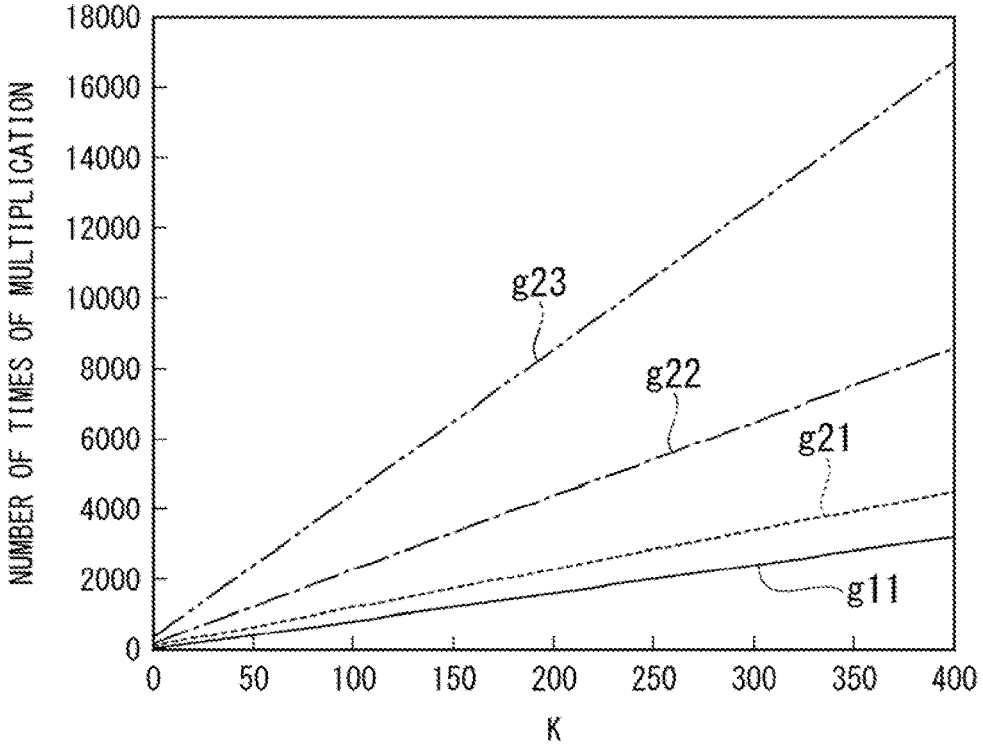
FIG. 8 is a diagram illustrating the number of times of calculation in a case in which the number M of microphones is 8 according to this embodiment.
Figure 9:
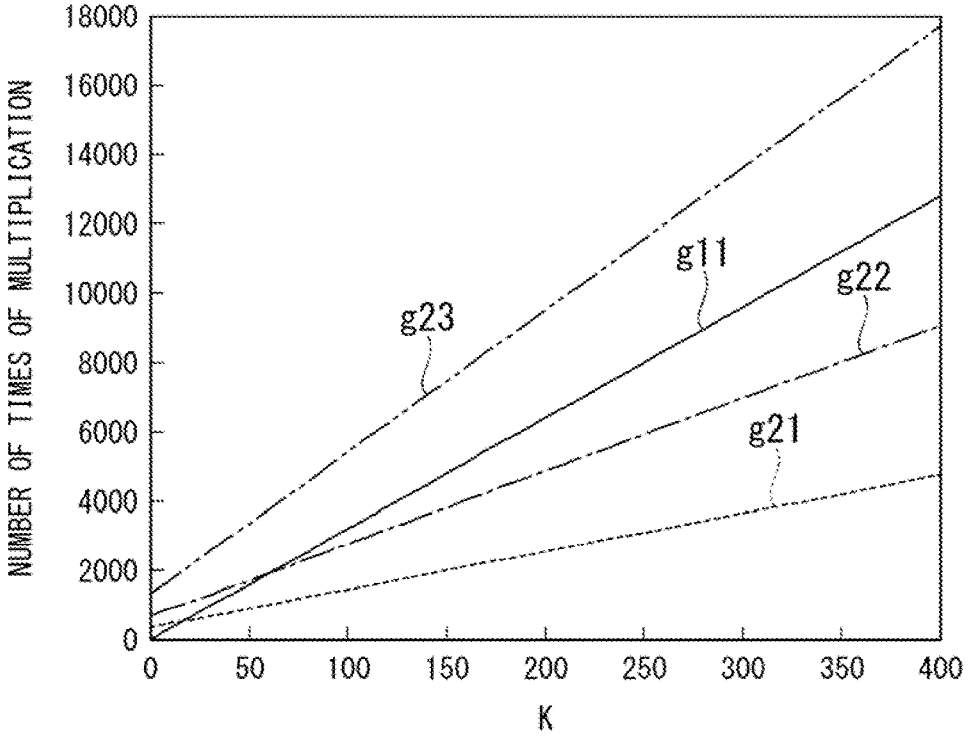
FIG. 9 is a diagram illustrating the number of times of calculation in a case in which the number M of microphones is 32 according to this embodiment.
Figure 10:
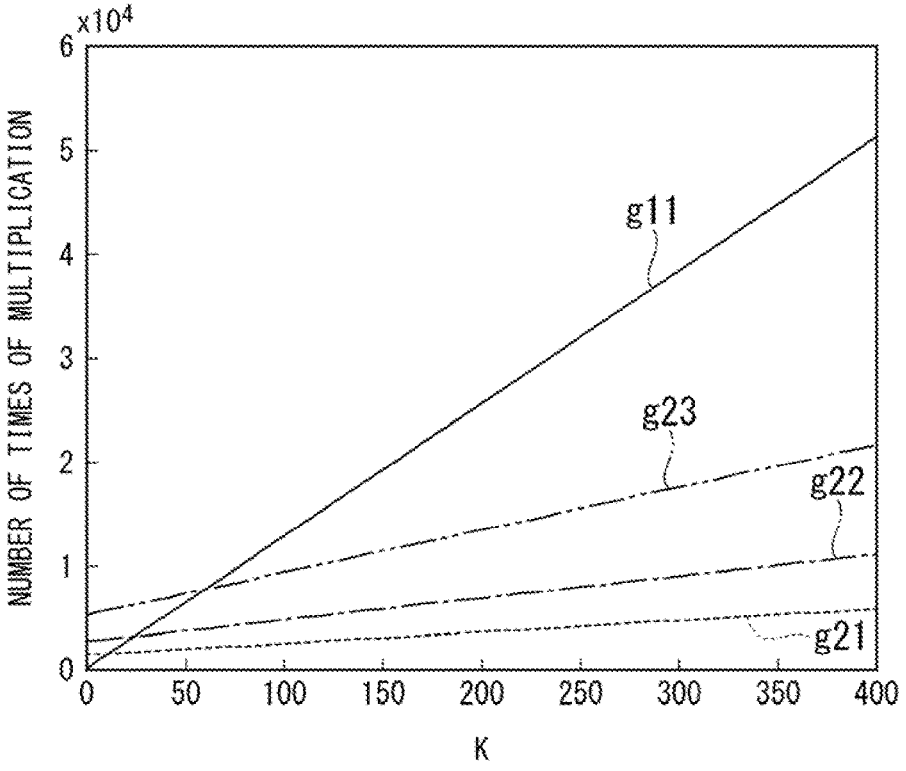
FIG. 10 is a diagram illustrating the number of times of calculation in a case in which the number M of microphones is 128 according to this embodiment.

FIGS. 8 to 10 are diagrams illustrating relationships between the number of microphones and the number of times of multiplication according to this embodiment.

FIG. 8 is a diagram illustrating the number of times of calculation in a case in which the number M of microphones is 8 according to this embodiment.

FIG. 9 is a diagram illustrating the number of times of calculation in a case in which the number M of microphones is 32 according to this embodiment.

FIG. 10 is a diagram illustrating the number of times of calculation in a case in which the number M of microphones is 128 according to this embodiment. In FIGS. 8 to 10, the horizontal axis is the number K of discrete angles, and the vertical axis is the number of times of calculation. In addition, a reference sign g11 represents the number of times of calculation MN according to a conventional technology. A reference sign g21 represents a case in which the complex Fourier model order N is the 5th, a reference sign g22 represents a case in which the complex Fourier model order N is the 10th, and a reference sign g23 represents a case in which the complex Fourier model order N is the 20th.

As illustrated in FIGS. 8 to 10, in a case in which the number M of microphones and the number K of discrete angles are large, and the complex Fourier model order N is small, compared to MN according to the conventional technology, the number of times of calculation can be decreased.

For this reason, the sound source localization unit 102 may select N satisfying the following Equation (18) in accordance with the number M of microphones 21 included in the sound receiving unit 2.

$$M\times K>(M+K)\ (2N+1) \tag{18}$$

[Processing Sequence]

Next, an example of the processing sequence of the sound processing device 1 will be described.

Figure 11:
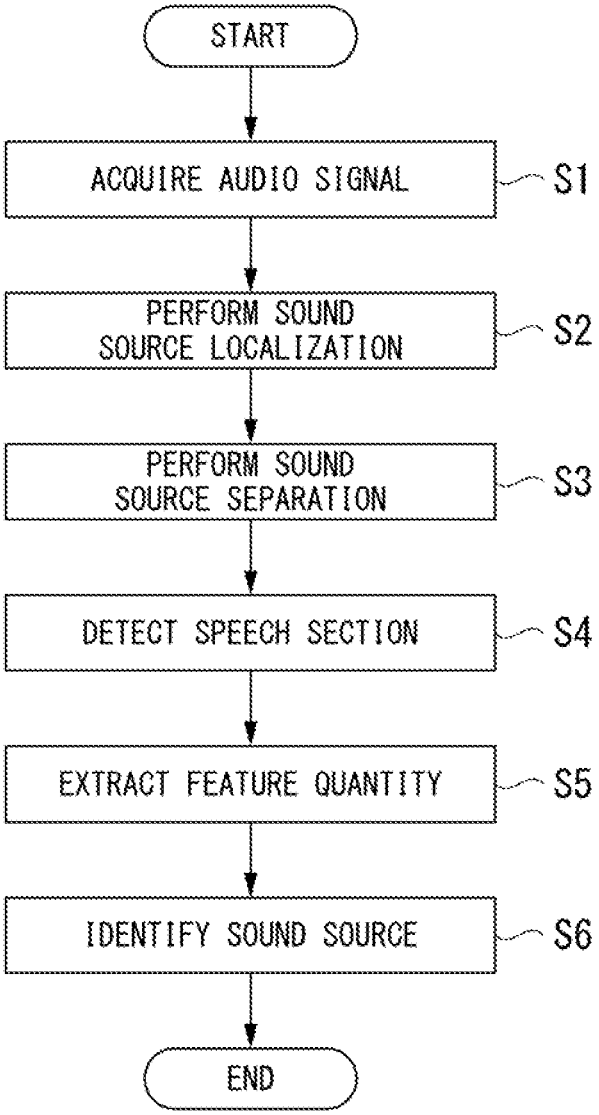
FIG. 11 is a flowchart of a process performed by a sound processing device 1 according to this embodiment.

FIG. 11 is a flowchart of a process performed by the sound processing device 1 according to this embodiment.

(Step S1) The sound receiving unit 2 receives an audio signal and outputs the audio signal of M channels that has been received to the acquisition unit 101.

(Step S2) The sound source localization unit 102 calculates an output of beam forming, for example, using a beam forming method. Subsequently, the sound source localization unit 102 sets a sound source direction of each sound source on the basis of the calculated output of beam forming.

(Step S3) The sound source separating unit 104 separates the audio signal of M channels into audio signals of individual sound sources, which are audio signals representing components of the sound sources, on the basis of the sound source direction represented by the sound source direction information, for example, using the GHDSS method.

(Step S4) The speech section detecting unit 105 detects a speech section of each sound source on the basis of spectrums of the separated audio signals and the sound source direction information.

(Step S5) The feature quantity extracting unit 106 calculates, for example, a Mel-frequency Cepstrum coefficient (MFCC) as an audio feature quantity for each sound source from the separated spectrums output by the speech section detecting unit 105.

(Step S6) The sound source identification unit 108 identifies a sound source by referring to an audio model stored in the audio model storing unit 107 on the basis of the audio feature quantity output by the feature quantity extracting unit 106.

In the example described above, although the example in which the beam forming method is used in the sound source localization process has been described, the used method is not limited thereto. A technique used in the sound source localization process may be the MUSIC method or the like, and, in a technique using a steering vector for each discrete angle, modeling can be applied using a complex Fourier coefficient of the N-th order described above.

In addition, in modeling using a complex Fourier coefficient of the N-th order, the used technique is not limited to the Fourier series expansion, and another technique such as Taylor expansion, spline interpolation, or the like may be used.

As described above, in this embodiment, since a steering vector is modeled through Fourier series expansion of the N-th (here, N is an integer equal to or larger than "1") order for each microphone, the amount of calculation of the steering vector can be decreased.

[Calculation of Beam Forming Value of Arbitrary Angle]

Here, it is assumed that a transfer function that has been measured in advance is for every 30 degrees.

For example, in Japanese Unexamined Patent Application Publication No. 2010-171785 (hereinafter, referred to as Patent Document 2), a technique for acquiring a transfer function in an intermediate direction on the basis of a small number of transfer functions of limited directions through interpolation has been disclosed. However, in the technology described in Patent Document 2, measured original transfer functions are limited to angles acquired by equally dividing the entire circumference by an integer. In addition, in the technology described in Patent Document 2, an angle of a transfer function that can be calculated through interpolation also needs to be an integral multiple of an interval of angles that are actually measured. For this reason, in the technology described in Patent Document 2, a transfer function value of an arbitrary intermediate angle cannot be acquired through interpolation.

In contrast to this, in this embodiment, a steering coefficient for each microphone 21 is modeled using a complex Fourier coefficient of the N-th order, and a steering vector database is stored in the table storing unit 1022. As a result, in this embodiment, the sound source localization unit 102 can acquire a sound source direction in sound source localization directly from a solution of polynomial without calculating an output value for every discrete angle.

Here, a method for calculating an output value of an arbitrary angle will be described for one-dimensional sound source localization in the horizontal direction using scanning beam forming as an example. In localization using scanning beam forming, an output value $Y_k$ of beam forming is calculated using the following Equation (19) for every $\theta_k$(here, k=1, 2, 3, . . . , K) as a discrete angle, and an index m at which $|Y_k|^2$ is a maximum is acquired, and the localization direction is output as $\theta_m$.

$$Y_k = \sum_{m=1}^{M} X_m(\omega) G_m(\theta_k, \omega) \tag{19}$$

In Equation (19), since $|Yk|^2$ is discrete (discontinuous) with respect to $\theta_k$, a peak of $|Yk|^2$ cannot be acquired from a solution for which a differential function thereof becomes zero.

In contrast to this, by modeling a steering coefficient $G_m(\theta_k)$ for each microphone 21 using a complex Fourier coefficient of the N-th order, the output $Y(\theta)$ thereof can be represented as in the following Equation (20) for an arbitrary angle $\theta$.

$$Y(\theta) = \sum_{n=-N}^{N} \exp(in\theta)\left(\sum_{m=1}^{M} X_m C_{nm}(\omega)\right) \tag{20}$$

In Equation (20), when $(\Sigma_{m=1}^{M} X_m C_{nm}(\omega))$ is substituted with $\alpha_n$, Equation (20) is represented as Equation (21).

$$Y(\theta) = \sum_{n=-N}^{N} \alpha_n \exp(in\theta) \tag{21}$$

In Equation (21), $\theta$ at which $|Yk|^2$ becomes a maximum satisfies the following Equation (22).

$$\frac{d|Y(\theta)|^2}{d\theta} = 0 \tag{22}$$

For this reason, by acquiring a solution of the equation represented in Equation (22), $\theta$ at which $|Yk|^2$ becomes a maximum can be acquired.

Since $|Y(\theta)|^2 = Y^*(\theta)Y(\theta)$, Equation (22) is represented as in the following Equation (23).

$$\frac{d|Y(\theta)|^2}{d\theta} = Y^*(\theta)Y'(\theta) + Y^{*\prime}(\theta)Y(\theta) \tag{23}$$

In Equation (23), Y*(θ) is represented using the following Equation (24), Y'(θ) is represented in the following Equation (25), and Y'* (θ) is represented in the following Equation (26).

$$Y^*(\theta) = \sum_{n=-N}^{N} \alpha_n^* \exp(-in\theta) \tag{24}$$

$$Y'(\theta) = \sum_{n=-N}^{N} n\alpha_n \exp(in\theta) \tag{25}$$

$$Y^{*\prime}(\theta) = \sum_{n=-N}^{N} n\alpha_n^* \exp(-in\theta) \tag{26}$$

For this reason, Equation (23) is represented as in the following Equation (27).

$$\frac{d|Y(\theta)|^2}{d\theta} = \left\{\sum_{n=-N}^{N} \alpha_n^* \exp(-in\theta)\right\}\left\{\sum_{n=-N}^{N} n\alpha_n \exp(in\theta)\right\} + \left\{\sum_{n=-N}^{N} -n\alpha_n^* \exp(-in\theta)\right\}\left\{\sum_{n=-N}^{N} \alpha_n \exp(in\theta)\right\} \tag{27}$$

In Equation (27), by setting exp(inθ) to x and setting $d|Y(\theta)|^2/d\theta$ to f(x), Equation (27) is represented as in the following Equation (28).

$$f(x) = \left(\sum_{n=-N}^{N} \alpha_n^* x^{-n}\right)\left(\sum_{n=-N}^{N} n\alpha_n x^n\right) + \left(\sum_{n=-N}^{N} -n\alpha_n^* \exp x^{-n}\right)\left(\sum_{n=-N}^{N} \alpha_n x^n\right) \tag{28}$$

In Equation (28), when a coefficient acquired by expanding a sum and arranging it in terms of $x_n$ is $\beta_n$, Equation (28) is represented as in the following Equation (29).

$$f(x) = \sum_{n=-2N}^{2N} \beta_n x^n \tag{29}$$

Since f(x)=0 is a solution of $x^{2N}f(x)=0$ from $x \neq 0$, a solution can be acquired from the following Equation (30).

$$x^{2N} f(x) = \sum_{n=0}^{4N+1} \beta_{n-2N} x^n = 0 \tag{30}$$

In other words, an angle θ at which a maximum value is acquired without having the angle θ to be discrete can be directly acquired as a solution of the polynomial.

In addition, since Equation (24) is an equation of the (4N+1)-th order, it can be calculated at a relatively high speed in a case in which N (the order) is low, and the error is also small.

As described above, according to this embodiment, even when a steering vector measured in advance is for every 30 degrees, a steering vector of an arbitrary angle can be calculated in addition to a median value of actually measured values using Equation (8). In this way, according to this embodiment, localization and separation can be performed with fine resolution. According to this embodiment, for example, even in a state in which there are only steering vectors measured at the interval of five degrees, data of localization can be acquired at the interval of one degree, and accordingly, an arrival direction of a sound source can be estimated with higher accuracy. In addition, according to this embodiment, since a steering vector of an arbitrary sound source direction can be generated even when the number of measurement points is decreased, the amount of data to be stored can be smaller than that of a conventional case.

In addition, in the example described above, although the method of calculating an output value of an arbitrary angle has been described for one dimensional sound source localization in the horizontal direction using scanning beam forming as an example, two-dimensional or three-dimensional sound source localization may be employed.

Furthermore, the technique for sound source localization is not limited to the scanning beam forming but may be the MUSIC method or the like.

In addition, all or some of the processes performed by the sound processing device 1 may be performed by recording a program used for realizing all or some of the functions of the sound processing device 1 according to the present invention on a computer readable recording medium and causing a computer system to read and execute the program recorded on this recording medium. A "computer system" described here includes an OS and hardware such as peripheral devices. In addition, the "computer system" also includes a WWW system having a home page providing environment (or a display environment).

A "computer-readable recording medium" represents a storage device including a portable medium such as a flexible disk, a magneto-optical disc, a ROM, or a CD-ROM, a hard disk built in a computer system, and the like. Furthermore, a "computer-readable recording medium" includes a recording medium that stores a program for a predetermined time such as a volatile memory (RAM) disposed inside a computer system that serves as a client or a server in a case in which a program is transmitted through a network such as the Internet or a communication line such as a telephone line.

In addition, the program described above may be transmitted from a computer system storing this program in a storage device or the like to another computer system through a transmission medium or a transmission wave in a transmission medium. Here, the "transmission medium" transmitting a program represents a medium having an information transmitting function such as a network (communication network) including the Internet and the like or a communication line (communication wire) including a telephone line. The program described above may be used for realizing a part of the functions described above. In addition, the program described above may be a program realizing the functions described above by being combined with a program recorded in the computer system in advance, a so-called a differential file (differential program).

As above, although forms for performing the present invention have been described using the embodiments, the present invention is not limited to such embodiments at all, and various modifications and substitutions may be applied within a range not departing from the concept of the present invention.

What is claimed is:

1. A sound source localization device comprising:

a sound receiving unit that includes two or more microphones; and a sound source localization unit that transforms a sound signal received by each of the microphones into a frequency domain, models a steering vector through Fourier series expansion of an N-th order for the transformed sound signal of the frequency domain for each of the microphones, calculates a steering vector of an arbitrary angle using the modeled steering vector, and performs localization of a sound source using the calculated steering vector of the arbitrary angle, wherein N is an integer equal to or larger than "1", and is set based on a number of microphones M and a number of discrete angles K.

2. The sound source localization device according to claim 1, further comprising a storage unit that stores a Fourier base function, wherein m represents an order of the microphone, $\theta_k$ represents a discrete direction, $\exp(in\theta_k)$ is a Fourier base function of an n-th order for an angle $\theta$, and $C_{nm}$ is a Fourier coefficient, and wherein the sound source localization unit performs sound source localization using a beam forming method and calculates a steering coefficient $G_m(\theta_k)$ of the steering vector using the following Equation $$G_m(\theta_k) = \sum_{n=-N}^{N} C_{nm}\exp(in\theta_k),$$

wherein m is an integer between "1" to M, and k is an integer from "1" to K.

3. The sound source localization device according to claim 2, wherein the sound source localization unit calculates a beam forming output Y by multiplying a matrix of the Fourier base function having K rows and (2N+1) columns by a matrix of the Fourier coefficients having (2N+1) rows and M columns.

4. The sound source localization device according to claim 2, wherein the sound source localization unit selects N for which (M+K)(2N+1) is smaller than (M×K).

5. The sound source localization device according to claim 2, wherein x is $\exp(in\theta)$, f(x) is $d|Y(\theta)|^2/d\theta$, $Y(\theta)$ is a beam forming output, and $\beta$ is a coefficient, and wherein the sound source localization unit performs sound source localization by acquiring an angle $\theta$ at which the beam forming output $Y(\theta)$ becomes a maximum by solving the following Equation $$x^{2N} f(x) = \sum_{n=0}^{4N+1} \beta_{n-2N} x^n = 0.$$

6. A sound source localization method that is a sound source localization method in a sound source localization device including a sound receiving unit that includes two or more microphones, the sound source localization method comprising:

transforming a sound signal received by each of the microphones into a frequency domain, modeling a steering vector through Fourier series expansion of an N-th order for the transformed sound signal of the frequency domain for each of the microphones, calculating a steering vector of an arbitrary angle using the modeled steering vector, and performing localization of a sound source using the calculated steering vector of the arbitrary angle by using a sound source localization unit, wherein N is an integer equal to or larger than "1", and is set based on a number of microphones and a number of discrete angles.

7. A computer-readable non-transitory storage medium storing a program causing a computer of a sound source localization device including a sound receiving unit that includes two or more microphones to execute:

transforming a sound signal received by each of the microphones into a frequency domain, modeling a steering vector through Fourier series expansion of an N-th order for the transformed sound signal of the frequency domain for each of the microphones, calculating a steering vector of an arbitrary angle using the modeled steering vector, and performing localization of a sound source using the calculated steering vector of the arbitrary angle, wherein N is an integer equal to or larger than "1", and is set based on a number of microphones and a number of discrete angles.

* * * * *